US007206425B2

(12) United States Patent
Vaudrey et al.

(10) Patent No.: US 7,206,425 B2
(45) Date of Patent: Apr. 17, 2007

(54) ACTUATOR FOR AN ACTIVE NOISE CONTROL SYSTEM

(75) Inventors: Michael A. Vaudrey, Blacksburg, VA (US); William R. Saunders, Blacksburg, VA (US); Andre Goldstein, Blacksburg, VA (US)

(73) Assignee: Adaptive Technologies, Inc., Blacksburg, VA (US)

( * ) Notice: Subject to any disclaimer, the term of this patent is extended or adjusted under 35 U.S.C. 154(b) by 550 days.

(21) Appl. No.: 10/762,127

(22) Filed: Jan. 21, 2004

(65) Prior Publication Data

US 2004/0151334 A1 Aug. 5, 2004

Related U.S. Application Data

(60) Provisional application No. 60/441,961, filed on Jan. 23, 2003.

(51) Int. Cl.
*H04R 25/00* (2006.01)

(52) U.S. Cl. ..... 381/328; 381/396

(58) Field of Classification Search ..... 381/322, 381/324, 328, 396, 400, 412
See application file for complete search history.

(56) References Cited

U.S. PATENT DOCUMENTS 5,757,946 A 5/1998 Van Schyndel
6,404,896 B1 6/2002 Yoo et al.
6,757,403 B2 6/2004 Urushibata et al.

OTHER PUBLICATIONS

K. Buck, et al. "An Active Noise Reduction Ear Plug with Driven Feedback Loop." The 2002 International Congress and Exposition on Noise Control Engineering Dearborn, MI USA. Aug. 19-21 2002.
Phillipe Herzog, "Electroacoustic Design of an Active Earplug." The 2002 International Congress and Exposition on Noise Control Engineering Dearborn, MI USA. Aug. 19-21 2002.
G.D. Martin, "On the Control of Flexible Mechanical Systems." PhD Dissertation, Stanford University, 1978.

*Primary Examiner*—Suhan Ni
(74) *Attorney, Agent, or Firm*—Roberts, Mardula & Wertheim, LLC

(57) ABSTRACT

An actuator for use with active noise control (ANR). The present invention satisfies design goals commensurate with active noise reduction devices used in small enclosed volumes and moderate-to-high noise environments. An ANR voice coil speaker is cylindrical in shape, with a diaphragm to motor diameter less than unity and fits into the ear canal. The rear cavity volume is on the same order of magnitude as the volume of the front cavity defined by the space between the diaphragm and the eardrum. The relatively balanced front/back volume of the ANR speaker reduces the required force to achieve a specific displacement required for high sound pressure output. An ANR balanced armature actuator uses a modified cabinet design, and a segmented or stiffened diaphragm made of light materials, and a sheet-type coupling between the armature and the diaphragm to reduce or eliminate resonances and phase lag within a desired control band. The actuator for use with ANR is well suited for an earplug that has been designed to provide active noise reduction in the ear canal.

4 Claims, 5 Drawing Sheets

425

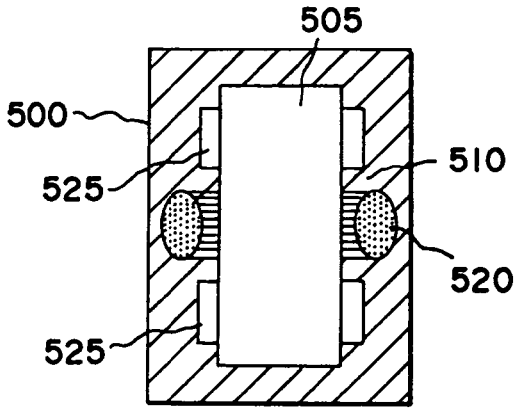
FIG. 5A
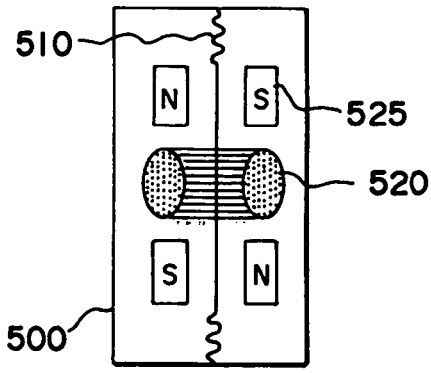
FIG. 5B
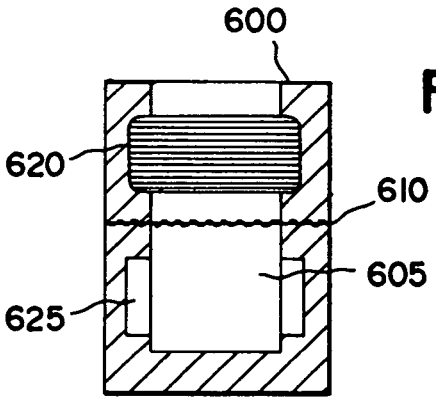
FIG. 6A
FIG. 6C
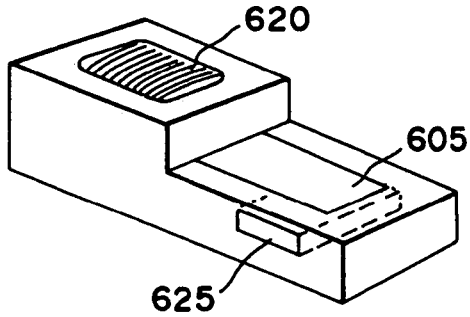
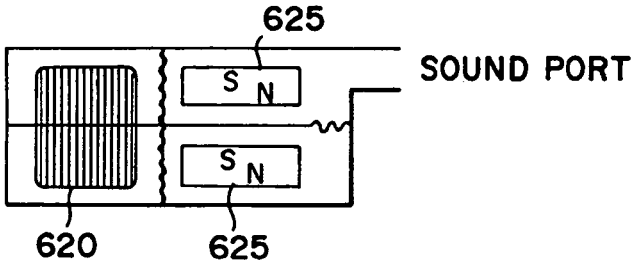
FIG. 6B

ACTUATOR FOR AN ACTIVE NOISE CONTROL SYSTEM

CROSS REFERENCE TO RELATED APPLICATIONS

This application claims priority under 35 U.S.C. § 119(e) from provisional application No. 60/441,961 filed Jan. 23, 2003. The 60/441,961 application is incorporated by reference herein, in its entirety, for all purposes.

BACKGROUND

The present invention relates generally to the field of active noise control. More specifically, the present invention is an actuator for use in completely-in-the-canal active noise control systems inside the ear.

Noise pollution is not merely an irritating aspect of urban life. In certain environments, such as airports, factories, and military operations, noise pollution poses a serious hazard to the hearing of those exposed. As a consequence, means have been devised to both passively and actively reduce the noise exposure of individuals who must work in these environments.

The first commercial devices combined noise filtering electronics with earmuffs to passively reduce ambient noise while amplifying speech and other desired sounds. The external noise, however, was not actively reduced in these devices.

Active noise reduction (ANR) followed. Earmuffs were combined with analog feedback technology to "cancel" undesired audio signals. The basic components of an ANR system are a microphone that "hears" the sound levels received at the ear of a listener, electronics that process the sound signal from the microphone and relay a cancellation signal to an actuator, and the actuator that converts a cancellation signal into sound pressure and "adds" it to the received signal, which added sound combines with the existing ambient noise to reduce the overall noise level. It is the "summing" of those signals that represents the active cancellation.

The effectiveness of an ANR system is influenced by a number of parameters, including by way of example, the location of the audio sensors, the varied shape of the human ear, the lag between signal detection and the creation of the cancellation signal, and the nature of the actuator and acoustic space.

Passive earmuffs (that is, ear coverings without ANR) theoretically provide protection against mid-to-high frequency noise in the audio bandwidth, reducing noise levels by as much as 25 dB or more, but are less efficient at low frequencies. Further, earmuffs are generally heavy, not comfortable, and impractical in environments where the user is shaken (as in heavy vehicles, for example).

Earmuffs with ANR are more effective at low frequencies, typically 600 Hz and below. As the desired control frequency range increases, the acoustic field represented by the volume inside the earmuff becomes more difficult to model and control. Over a broader frequency spectrum, the number of acoustic modes within this acoustic field increases, making control more difficult.

One way to increase the controlled frequency spectrum and reduce the number of acoustic modes is to reduce the size of the acoustic field. Reduction of the acoustic field is accomplished by substituting an earplug for the earmuff. From a strict acoustic perspective, an active earplug placed in the ear canal should be able to control from low frequencies up to "high" frequencies (e.g., several kilohertz). However, the reduction in size of the ANR system leads to a number of significant design issues, particularly the design of the system component that converts electrical signals to sound pressure (referred to herein generically as an "actuator").

A number of designs of earplugs with ANR are described in "An Active Noise Reduction Ear plug with Digitally Driven Feedback Loop," by K. Buck, V. Zimpter and P. Hamery, a paper presented at Inter-Noise 2002, the International Congress and Exposition on Noise Control Engineering, Aug. 19–21, 2002 (herein, "Buck"). One such design used a walkman-type loud speaker and a Knowles miniature microphone (as used in hearing aids). According to Buck, the results were not impressive, largely due to the electroacoustic transfer function of the walkman-type loud speaker.

Buck also describes a piezoceramic actuator. A flat-plate type device exhibited an electroacoustic transfer function that was amenable to ANR applications. However, the pressure output of the flat-plate piezoceramic actuator was insufficient for ANR applications, particularly in a noisy environment. A tube-type piezoceramic actuator was also tested. Like the flat-plate design, the transfer function of the tube-type piezoceramic actuator was acceptable, but the prototype's electric energy conversion was too inefficient for commercial applications. Buck concludes that:

> the main problem in designing ANR earplugs are the transducers [actuators]. If electrodynamic earphones shall be used, the amplitude phase relationship observed is often not minimum phase, and so, impedes on the bandwidth of the active attenuation. Piezoceramic devices show a good behavior as far as the transfer functions are concerned, however, the output levels that can be reached under realistic circumstances are still too low.

Another paper, "Electroacoustic Design of an Active Earplug," by Phillipe Herzog, a paper presented at Inter-Noise 2002, the International Congress and Exposition on Noise Control Engineering, Aug. 19–21, 2002 (herein, "Herzog"), also discusses the design of earplugs with ANR. Herzog comments on the design constraints posed by current choices for actuators:

> The piezoelectric speaker would allow to use a simpler control filter, but still require expensive developments. An cheaper solution, requiring also a simple control filter, would be electret speaker, if a relatively low pressure is to be controlled. Conversely, the emergence efficient numerical control filters may allow us to use existing dynamic speakers. In any case, the maximum pressure inside the ear canal remains a critical criterion.

Buck and Herzog both focus on the actuator as a weak link in the design of an effective earplug with ANR system. Notably, both papers discuss the use of filters as a means for compensating for the deficiencies of various existing actuators. Unfortunately, there are well-known limitations on the compensation that can be offered by the filter designs and this approach cannot correct the technical deficiencies associated with current actuator designs when used in an ANR earplug system.

Actuators useful for ANR earplug designs must be very small. Two choices are available. First, the actuator can be placed in the portion of the earplug that fits into the concha of the ear. The dimensions of this space depend on the user, with mean areas on the order of 13 mm×8 mm and mean depths of that space of approximately 3–4 mm. Second, the actuator can be placed completely-in-the-canal (CIC) where the dimensional constraints are even more stringent. From a size perspective, current actuator designs that could possibly be used for ANR earplugs are limited to hearing aid speakers and so-called microspeakers, such as those used in earbud products. The smallest available microspeakers are approximately 10 mm in diameter. Although the smallest available microspeakers may fit in some percentage of user's concha spaces, the ANR performance cannot optimally satisfy all of the ANR objectives when the speaker is in that location. Hence, there is a need for new voice coil ANR actuator designs that can be used in the CIC ANR application. That leaves only the subminiature hearing aid actuators that could possibly be fit into a CIC ANR earplug design.

In addition there are electroacoustic design limitations for existing hearing aid speakers and microspeakers that could be used in the CIC or concha earplug designs, respectively. Until now, actuators have been designed to fulfill the audio or hearing aid applications for which they were intended, and are generally not well suited for feedback active noise reduction. In order to optimize an actuator for in-the-ear ANR, the actuator dynamics, power handling capabilities, and dimensional sizing must be simultaneously considered.

A practical actuator for in-the-ear ANR should achieve a high percentage fit rate. For CIC designs, this consideration further restricts the size of the actuator. Measurements of a population of human ear canals reveal that 95% of the smallest ear canal diametrical dimensions are larger than approximately 5.5 mm. Allowing for an earplug wall thickness of approximately 1.5 mm results in a two-sigma width dimensional limitation of the actuator of 4 mm. Other measurements of the length of the ear canal reveal that approximately 95% of the population have an ear canal length of greater than 11 mm. This places a two-sigma length dimensional constraint on the actuator design. Ideally, the actuator could be made smaller and still satisfy the remaining goals of the design.

In addition to size constraints, the actuator has two more relevant constraints for use in active noise control. First, the sound power output of the actuator must be sufficient to accommodate the sound pressures required for control. This is an increasingly challenging goal as the ambient sound pressures to be controlled increase but the size of the actuator decreases to meet the geometrical constraints. To a first approximation, the sound pressure levels that can be created inside the occluded space of the ear canal are proportional to a volume change inside that occluded space. Larger volume changes are required to generate higher sound pressure levels. The volume change of the occluded space is equal to the displacement of the actuator times the actuator area. Therefore, the ANR application calls for very small profile actuators that still provide required volumetric changes with reduced diaphragm areas. Actuator design methods and embodiments for achieving this volume change are explained in the following paragraphs.

The remaining challenge for an ANR actuator is related to the frequency response of the device, as referred to a voltage (input) applied to the motor terminals and a microphone measurement of the sound pressure (output) produced in the earplug user's occluded ear canal space by the actuator. (Here, the "motor" of a speaker refers to the combination of the magnet and coil that together cause motion of the diaphragm through an electrical current running in the coil). It is desirable to construct an actuator that minimizes the occurrence of dynamic properties or resonances (a large pole-zero excess) leading to phase lag across the control bandwidth. More specifically, minimizing the amount of phase that is present in the actuator input-to-output frequency response is very desirable, and minimizing the number of dynamics is one way to accomplish this goal. A second way to achieve this goal is to construct an actuator that does not interrupt the linear systems theoretical property, referred to as collocation, where an alternating pole-zero pattern characterizes the transfer function of systems that satisfy collocation (See, Martin, G. D., "On the Control of Flexible Mechanical Systems," PhD Dissertation, Stanford Univ, 1978). Collocation defined in this way ensures that the phase across the frequency band of interest will be minimized. Current designs from the audio community and the hearing aid community are not concerned with achieving this goal of minimum phase across the audio bandwidth because phase response is not important for either application.

The audio community most typically employs designs that are referred to as voice coil speakers. These consist of a coil of wire attached to a diaphragm, where the coil of wire is situated in a magnetic field. A typical voice coil speaker is illustrated in FIG. 1. Diaphragm 105 is suspended by its outer edge from frame 100 by suspension 110. The inner edge of diaphragm 105 is suspended from the frame 100 by spider 115. The center of the diaphragm 105 is attached to voice coil 120. The voice coil 120 is suspended in a magnetic field generated by magnet assembly 125. The speaker is characterized by the diameter "D" of diaphragm 105 and motor depth "M", which is a measure of the greater of the magnet assembly 125 length or the length of the voice coil 120. When an electrical voltage is applied to voice coil 120, opposing magnetic fields induce diaphragm 105 to move. This diaphragm motion then displaces air particles generating sound pressure that is proportional to the applied voltage or applied current. The consumer and professional markets have not driven voice coil speaker technologies toward sizes that are small enough to fit in a human ear canal because until now there has not been a technical need.

As introduced above, ANR technology can benefit from decreased actuator size and by placing the actuator as deep as possible in the ear canal to minimize the volume change requirements from the speaker. Microspeakers used strictly for audio applications utilize a geometrical profile wherein the diaphragm diameter is equal to or perhaps larger than the depth of the speaker motor (defined to be the magnet and wound coil below the diaphragm). For the CIC application, this acoustical consideration is no longer the fundamental consideration, thereby relaxing the need for large diaphragm diameters and allowing new speaker designs with diaphragm to motor depth ratios below unity. Conventional voice coil designs employ a diameter to motor dimensional ratio of one or greater. As discussed above, the conventional microspeaker geometry is not amenable to ear canal because the diameters are too large for the CIC dimensions cited earlier. However, if the microspeaker were simply reduced proportionally to its conventional profile, the sound output power would not be high enough to enable effective active noise control. Another disadvantage of existing voice coil technologies is that the diameters that are available today are too large to fit in the ear canal and the diaphragm stiffness of such devices are marginal in being able to resist high acoustic load forces that are present when the device is used in a very small space. Although the smallest available microspeakers may fit in some percentage of user's concha spaces, the ANR performance cannot optimally satisfy all of the ANR objectives when the speaker is in that location.

The unique problem of fitting a new speaker design completely-in-the-canal also affects the speaker design from an acoustic perspective. It is well known in acoustic theory that a speaker can be approximated by a radiating piston whose efficiency of radiation into an ambient medium is proportional to the diameter of the piston. Therefore, in order to achieve satisfactory acoustic response at low frequencies (below 500 Hz), the speaker diameter must be an appreciable portion of the acoustic wavelength. Existing microspeaker dynamic voice-coil designs for audio applications have been selected using the conventional profile described above, where the speaker diaphragm is typically larger than the depth of the speaker motor (the greater of the magnet or voice coil dimension) and leads to acceptable radiation efficiency.

The hearing aid industry has almost exclusively employed balanced armature technologies to deliver high sound power in a small package. The modern balanced armature or reed driven devices employ a voltage driven coil that changes the polarity of an armature in the presence of a permanent magnetic field. When the polarity alternates with the alternating voltage, the armature moves toward or away from one of the permanent magnet poles. The armature is attached to a diaphragm via a very tiny rod. When the armature moves, the diaphragm moves and generates a change in volume. The front of the diaphragm is covered by a front enclosure that leads to a small port where the sound exits. The port and enclosure are designed into these devices to protect the diaphragm, provide a means to secure the diaphragm to the hearing aid housing, to change the load impedance on the diaphragm, and to provide a way to attach a tube to the actuator.

A typical balanced armature actuator is illustrated in FIG. 2. Diaphragm 205 is suspended by its outer edge from housing 200 by suspension 210. Diaphragm 205 is connected to armature 208 by coupling member 215. Voice coil 220 surrounds a portion of armature 208. The opposite end of armature 208 is suspended in a magnetic field generated by magnet assembly 225. Housing 200 covers diaphragm 205 creating enclosure 235. Sound exits through enclosure 235 through port 230.

Balanced armature manufacturers are currently motivated by the hearing aid industry and tailor their designs accordingly. Overall phase lag in a design is not important, whereas additional sound power output is important. By adding resonant dynamics, the sound power output of the balanced armature speaker designs are effectively increased at the expense of additional phase lag.

There are a variety of dynamic systems in the traditional balanced armature actuator that make it suboptimal for active control:

- an acoustic system in front of the diaphragm that is separate from the occluded space environment;
- a port that is used to connect the actuator to a tube in hearing aids that acts as a Helmholtz resonator that also adds additional dynamics in the control band;
- vibrational modes of the diaphragm and reed itself;
- the mass-spring-damper system of the moving driven diaphragm;
- the dynamic system of the magnetically driven armature; and
- a compressional mode of the rod connecting the armature and diaphragm.

All of these dynamics present significant amounts of phase lag, or pole-zero excess, in the frequency response of the input voltage to output sound pressure of the actuator. The connectivity of the different dynamic systems also precludes the opportunity for collocated response as measured in the acoustic domain. The increased phase lag from the dynamics and non-collocation limits the amount of active noise control attenuation that can be achieved, and especially the bandwidth over which it can be achieved.

There are several significant disadvantages to this type of actuator design when employed with active noise control in a high noise environment. First, current state of the art designs have difficulty achieving the highest required sound pressure levels for ANR in very high noise fields while still fitting inside a human ear canal. Second, the balanced or reed armature design described above exhibits a mechanical resonance, speaker cabinet resonances, and other structural dynamic resonances associated with the armature's mechanical design. Because of the series and/or parallel connections of the different acoustic (cabinet) and mechanical (diaphragm/reed) system resonances, and their respective couplings to the acoustical field, all existing balanced armature actuators built for in-ear devices preclude the opportunity for collocated input-output dynamic response between the speaker driving voltage and a microphone placed in the acoustic field. This degradation of collocated response has negative impact on the phase lag of the frequency response, and hence on the effectiveness of feedback active noise control, as is well known by those versed in the art.

What is needed is an actuator that meets the geometrical constraints for CIC placement, that is able to effect volumetric changes in the resulting occluded space of the ear such that sound pressures in that space are sufficient for control, and that exhibits specific dynamic properties that lead to stable, high performance closed-loop ANR response.

SUMMARY

An embodiment of the present invention is an actuator specifically designed for ANR applications. The actuator according to the present invention fits completely in the human ear canal, provides a minimal number of dynamics or phase lag in the control bandwidth, and delivers the sufficient sound pressure levels to provide active noise reduction.

As discussed above, conventional voice coil designs employ a diaphragm-diameter-to-motor-dimension ratio of one or greater. This design constraint is not applicable in the design of a CIC ANR actuator because acoustic radiation into a small, occluded space is not governed entirely by the same principles. Acoustic excitation of the small, occluded space in the ear canal, after insertion of a CIC speaker and microphone, relies essentially on a change in volume. As the occluded space becomes smaller, the steady-state sound powers inside that space can be higher for a constant speaker diaphragm displacement since the steady-state level is governed only by the speaker power and the acoustic absorption of the interior (occluded) space.

It is an aspect of the present invention to employ this principle in an embodiment of an actuator in which the diaphragm is considerably smaller than prior microspeaker designs and the motor depth is considerably larger than prior microspeaker designs, thus creating a diaphragm-diameter-to-motor-dimension ratio that is less than unity. This allows the volume change inside the occluded space to be achieved by trading off diaphragm area for voice coil displacement, such that required acoustic volume velocities can be achieved with significantly smaller diaphragm diameters. As discussed earlier, there is approximately 11 mm of ear canal length that can be used to design the required voice coil motor such that broadband sound pressure levels in excess of 110 dB can be reached.

Another aspect of the present invention is an actuator in the form of a voice coil speaker with a new geometrical profile that is optimized for CIC active noise reduction applications.

Yet another aspect of the present invention is to increase heat dissipation of a voice coil speaker optimized for CIC active noise reduction applications.

Another aspect of the present invention is an actuator in the form of an ANR balanced armature actuator having a geometrical profile, cabinet construction, and diaphragm construction that are optimized for CIC active noise reduction applications.

An aspect of the present invention is a balanced armature actuator receiver cabinet having an associated acoustic dynamic response that is less than that associated with prior cabinet designs.

Yet another aspect of the present invention is a hybrid actuator that combines the force handling capability of the balanced armature actuator with the dynamic system characteristics of a voice coil speaker.

In an embodiment of the present invention, a voice coil speaker is optimized for ANR applications (the "ANR speaker"). According to this embodiment, the diameter of the ANR speaker is reduced (by comparison to currently available speakers) to fit in the ear canal while the displacement of the ANR speaker voice coil is increased to create sufficient sound pressure for ANR applications. In this embodiment, the ANR speaker has a unique geometrical profile as compared to existing voice coil speakers. The geometrical change to a diaphragm-diameter-to-motor-dimension ratio less than unity allows for an increase in the number of coils, which further increases heat dissipation, increases the diaphragm displacement, decreases the diaphragm diameter, and leads to a higher fit rate into the ear canal. The cylindrical aspect ratio (i.e. geometrical design of the speaker motor) for a CIC acoustic actuator takes advantage of the ear canal's lengthwise dimension in order to increase motor size significantly compared to conventional cylindrical voice coil microspeakers. The resulting improvement in voice coil displacement allows the actuator to maintain a high volume velocity for a diaphragm area that must be reduced by nearly seventy-five percent beyond any currently available microspeaker designs.

In another embodiment of the present invention, the heat dissipation of the ANR speaker is increased through the use of ferro-fluid material in the magnetic field gap and a heat sink device to conduct heat from the ANR speaker to the exterior of the ear canal.

Another embodiment of an ANR speaker comprises a very stiff diaphragm to accommodate high force requirements and to limit the number of "cone break up" modes. In this embodiment, the smaller size of the diaphragm limits these modes to higher out-of-band frequencies. In addition, the ANR speaker comprises a voice coil winding made from wire having a flat cross section. The flat cross section of the winding wire permits the voice coil to have a higher number of turns for the same volume of coil. This permits the higher excursions of the voice coil required when driving lower frequency sounds.

Another embodiment of the present invention is an actuator in the form of a balanced armature actuator that is optimized for active noise reduction applications (an "ANR balanced armature actuator"). In this embodiment, the length of a balanced armature device typically used in CIC hearing aid devices is extended. Extending the length of the outer dimensions of the casing permits the ANR balanced armature actuator to use a larger diaphragm area, a greater number of coils, and a larger magnet than used in hearing aid applications. Each of these modifications leads to higher displacement of air and higher sound pressure levels.

Another embodiment of the ANR balanced armature actuator is related to the cabinet geometry. The cabinet has conventionally been essentially closed with a single ported outlet located somewhere along one of the cabinet sides. The acoustic port leads to unwanted acoustic dynamics that reduce the effectiveness of ANR controllers. According to embodiments of the present invention, a completely inside the ear canal ("CIC") speaker comprises a diaphragm of diameter "D" and a magnet assembly of length "L" measured along the dimension orthogonal to the diaphragm. The magnet assembly defines a cylindrical magnetic gap. A voice coil comprises a first portion that is rigidly attached to the diaphragm and a second portion placed in the cylindrical magnetic gap. The voice coil has a depth "M" measured along the dimension orthogonal to the diaphragm surface. In this embodiment, M>L and the ratio defined by D/M is less than one. Optionally, the voice coil is formed of wire having a rectangular cross-section. Additionally, the magnet assembly comprises a magnet having a high flux density. In an embodiment of the present invention, D does not exceed 4 mm. In yet another embodiment of the present invention, the length of the CIC speaker does not exceed 11 mm.

In an embodiment of the present invention, a CIC speaker has a first resonance frequency between 0 and 10 kHz, a second resonance frequency greater than or equal to 10 kHz, and sufficient voice coil linear motion to produce at least 115 dB in a 0.5 cubic centimeter volume.

In yet another embodiment of the present invention, a CIC speaker further comprises a closed-loop feedback controller adapted to provide linear motion of the voice coil during closure of the magnetic circuit between the voice coil and magnetic gap.

According to embodiments of the present invention, a completely inside the ear canal ("CIC") speaker comprises a diaphragm of diameter "D" and a magnet assembly of length "L" measured along the dimension orthogonal to the diaphragm. The magnet assembly defines a cylindrical magnetic gap. A voice coil comprises a first portion that is rigidly attached to the diaphragm and a second portion placed in the cylindrical magnetic gap. The voice coil has a depth "M" measured along the dimension orthogonal to the diaphragm surface. In this embodiment, M<L and the ratio defined by D/M is less than one. Optionally, the voice coil is formed of wire having a rectangular cross-section. Additionally, the magnet assembly comprises a magnet having a high flux density. In an embodiment of the present invention, D does not exceed 4 mm. In yet another embodiment of the present invention, the length of the CIC speaker does not exceed 11 mm.

In an embodiment of the present invention, a CIC speaker has a first resonance frequency between 0 and 10 kHz, a second resonance frequency greater than or equal to 10 kHz, and sufficient voice coil linear motion to produce at least 115 dB in a 0.5 cubic centimeter volume.

In yet another embodiment of the present invention, a CIC speaker further comprises a closed-loop feedback controller adapted to provide linear motion of the voice coil during closure of the magnetic circuit between the voice coil and magnetic gap.

According to embodiments of the present invention, a CIC actuator comprises a housing having a length 11 mm or less and a diametrical dimension of 4 mm or less. A first magnet assembly defines a first magnetic gap. The first magnet assembly is located at an end of the housing and the first magnetic gap is adapted to form a north-south orientation of magnetic poles. A second magnet assembly defines a second magnetic gap. The second magnet assembly is located opposite the first magnet assembly. The second magnetic gap adapted to form a south-north orientation of magnetic poles. A flexible suspension element is adapted to directly secure a diaphragm to the internal surface of the housing and to suspend the diaphragm between the first magnetic gap and the second magnetic gap. A voice coil surrounds the diaphragm. The diaphragm, the flexible suspension element, and the enclosure define a sealed cavity separating the front of the diaphragm and the back of the diaphragm. The flexible suspension bisects the first and second magnet assemblies and the voice coil.

According to embodiments of the present invention, a CIC actuator comprises a housing having a length 11 mm or less and a diametrical dimension of 4 mm or less. A magnet assembly located at a first end of the housing defines a magnetic gap. A diaphragm is connected to the sides of the housing by a first flexible suspension element. The point of attachment of the first flexible suspension element to the diaphragm defines a first diaphragm segment and a second diaphragm segment. The first diaphragm segment is situated in the magnetic gap and attached to the first end of the housing via a second flexible suspension element. The second diaphragm segment is attached to a second end of the housing. A voice coil surrounds the second diaphragm segment.

According to embodiments of the present invention, a CIC actuator comprises a housing having a length 11 mm or less and a diametrical dimension of 4 mm or less and a first diaphragm and second diaphragm of about the same size. The first diaphragm and the second diaphragm are attached to the inside perimeter of the housing and to each other via a flexible suspension element. The first diaphragm and the second diaphragm are powered by a common excitation signal. An armature comprises a first end segment, a middle segment, and a second end segment. A first voice coil surrounds the first end segment. A second voice coil surrounds the second end segment. The first voice coil and second voice coil are adapted to receive a common excitation signal simultaneously. A magnet assembly defining a magnetic gap is disposed in the housing so as to locate the middle segment of the armature in the magnetic gap. A first coupling member connects the first segment to the first diaphragm. A second coupling member connects the second segment to the second diaphragm.

According to embodiments of the present invention, a CIC balanced armature actuator comprises a housing having a length 11 mm or less and a diametrical dimension of 5 mm or less and a sound producing diaphragm. The sound producing diaphragm is connected to an armature that moves in a permanent magnetic field by a connecting rod. The sound producing diaphragm is acoustically exposed to the environment in which it operates via a sound port having an opening that is at least 25% as large as the diaphragm surface area.

DESCRIPTION OF THE DRAWINGS

FIG. 5 illustrates a hybrid actuator according to embodiments of the present invention.

FIG. 6 illustrates a hybrid actuator according to other embodiments of the present invention

DETAILED DESCRIPTION

In an embodiment of the present invention, a voice coil speaker is optimized for ANR applications. In voice coil speakers designed for other applications, the voice coil is considered to be a relatively high displacement, but low force actuator. This design is not ideal for the small, enclosed volume represented by the human ear canal in which relatively high forces are desired to change trapped volumes enough to achieve high sound pressure levels. Further, in a typical speaker arrangement, the rear cavity (as illustrated in FIG. 3) is a very small volume and requires significant force to change its volume (if the diaphragm moves, the volume must change on either side of it).

Figure 3:
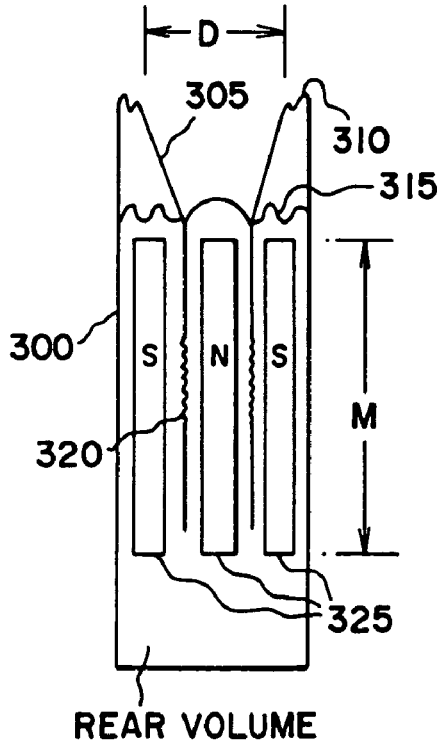
FIG. 3 illustrates the components of an ANR voice coil speaker with a diaphragm diameter to motor depth less than unity according to embodiments of the present invention.

Referring to FIG. 3, an ANR speaker according to an embodiment of the present invention is illustrated. A diaphragm 305 is suspended by its outer edge from housing 300 by a suspension 310. The inner edge of diaphragm 305 is suspended from the housing 300 by a spider 315. The center of the diaphragm 305 is attached to a voice coil 320. Voice coil 320 is suspended in a magnetic field generated by a magnet assembly 325. The ANR speaker in this embodiment is characterized by diaphragm diameter "D", motor depth "M", rear volume or rear cavity volume "RCV", and front cavity volume "FCV". When placed in a sealed earplug, the FCV is the distance between the user's eardrum and the front edge of the diaphragm 305.

The ANR speaker in this embodiment utilizes a cylindrical shape that fits into the ear canal utilizing a geometrical profile where the diaphragm-diameter-to-motor-dimension ratio is less than unity ($D/M<1$). By using a diaphragm-diameter-to-motor-dimension ratio that is less than unity, larger coil displacements can be used to achieve high acoustic volume velocities required for ANR even when the diaphragm diameter is equal to or less than 4 mm. This embodiment further permits the RCV to be on the same order of magnitude as the FCV (defined by the space between the diaphragm and the eardrum). The relatively balanced front/back volume of the ANR speaker reduces the required force to achieve a specific displacement of diaphragm 305 to produce a high sound pressure output.

In another embodiment according to the present invention, the coil length "L" is smaller than the magnet length "M" so that the movement of the coil in the magnetic field is linear. In addition, the coil wire has a flat cross section that allows a higher number of turns for the same volume of coil. This aspect of the present invention permits the longer excursions of the voice coil required when driving lower frequency sounds. In an alternate embodiment, the linearity of the movement of the coil is refined by using a closed-loop control algorithm to linearize the resulting displacements of the voice coil, especially in applications involving low frequency noise producing long coil excursions.

Another embodiment of the present invention is an actuator in the form of a balanced armature actuator that is optimized for active noise reduction applications (an "ANR balanced armature actuator") by providing higher sound power and less phase lag in the ANR control bandwidth.

Figure 4:
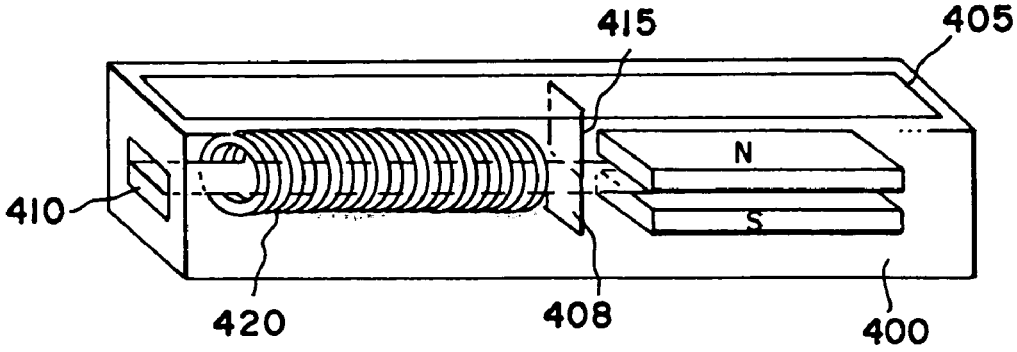
FIG. 4 illustrates the components of an ANR balanced armature actuator according to embodiments of the present invention.

Referring to FIG. 4, an ANR balanced armature actuator according to an embodiment of the present invention is illustrated. In this embodiment, the length of a balanced armature device typically used in hearing aid devices is extended up to about 11 mm while the maximum diametrical dimension is limited to approximately 4–5 mm. Here the "diametrical dimension" is defined as the greatest linear dimension of the outer case. For a rectangular case, this corresponds to the hypotenuse. Extending the length of the outer dimensions of the casing permits the ANR balanced armature actuator to comprise a larger diaphragm, a greater number of coils, and a larger magnet over the prior art. Each of these modifications leads to higher displacement of air and higher sound pressure levels inside the ear canal. The ANR balanced armature actuator of the present invention also reduces the number of dynamics present in a typical balanced armature actuator thereby making it useful in active noise reduction applications.

Figure 1:
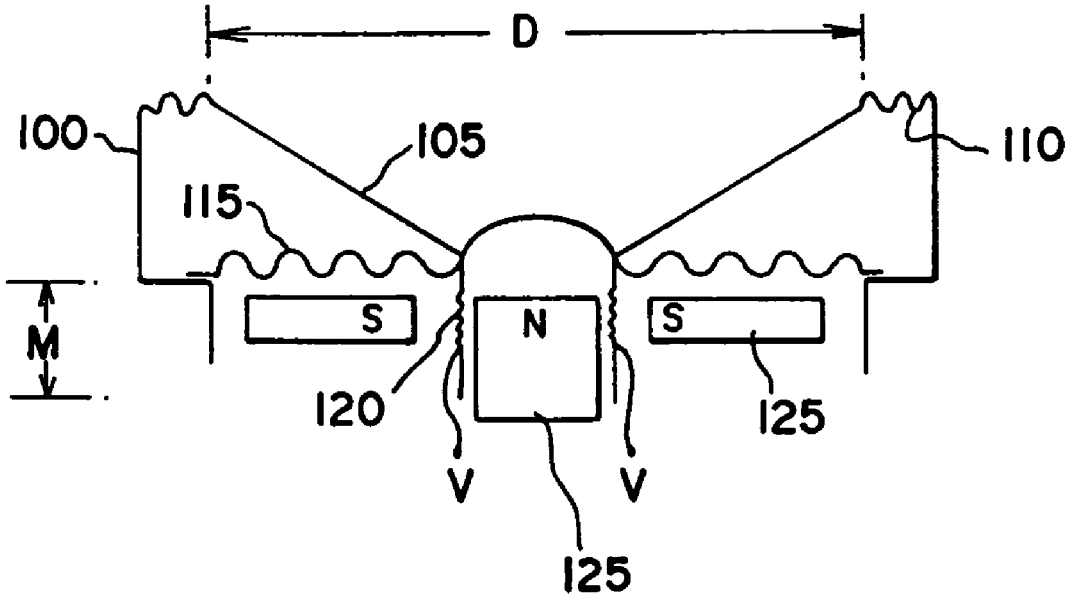
FIG. 1 illustrates the components of a typical voice coil speaker.
Figure 2:
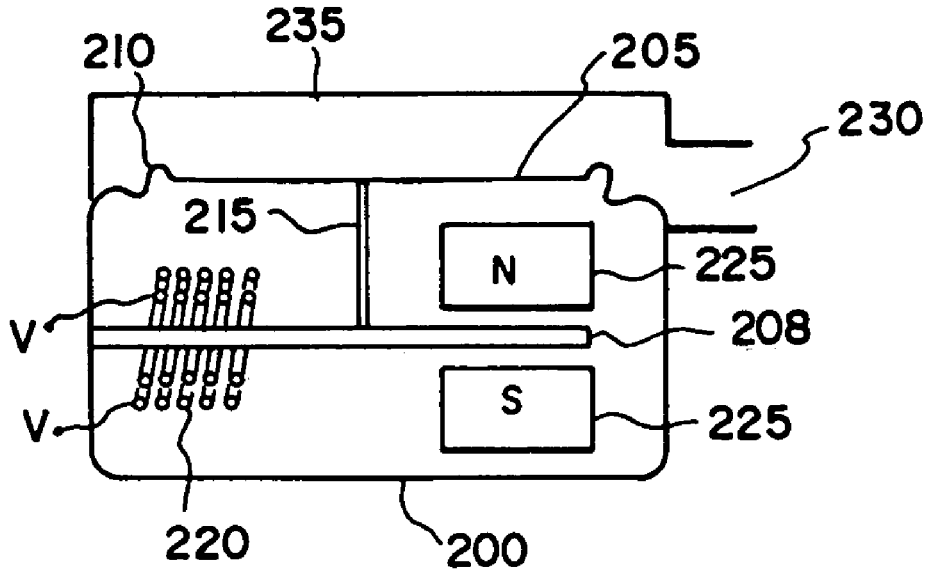
FIG. 2 illustrates the components of a typical balanced armature actuator.

A diaphragm 405 is suspended by its one end from a housing 400 by a suspension 410. Diaphragm 405 is connected to an armature 408 by a coupling member 415. Voice coil 420 surrounds a portion of armature 408. The opposite end of armature 408 is suspended in a magnetic field generated by a magnet assembly 425. By contrast to the traditional balanced armature actuator, in this embodiment housing 400 does not cover diaphragm 405, thus eliminating the front enclosure and port (see FIG. 2) and at least one of the in-band resonances (either Helmholtz resonance or acoustic cavity resonance) that represents a source of unwanted phase lag. To compensate for the loss in stiffness of the diaphragm caused by the removal of the front enclosure, the diaphragm suspension 410 is stiffened by using a stiffer material than ordinarily used for the suspension to connect the diaphragm to the speaker housing.

Idealized voice coil speaker designs have predominantly one in-band resonance, that of the rigid vibration of the diaphragm. The diaphragm is actuated directly by the coil moving in the magnetic field. In current balanced armature actuators, the coupling means between the diaphragm and armature is typically a small piece of wire. This single-point mechanical coupling design exacerbates vibration of not only the diaphragm but the armature as well and results in undesired resonances within the control band.

As illustrated in FIG. 4, the coupling member 415 of the ANR balanced armature actuator can also be a small sheet that connects armature 408 to diaphragm 405. Coupling member 415 contacts armature 408 along the length of the coupling member 415 (rather than at a single point attachment point). By coupling the armature and diaphragm with a larger structural member, resonances can be eliminated or shifted out of the control band. Because the sheet-type coupling member attaches to the diaphragm along a line, the diaphragm is further stiffened, raising the diaphragm's fundamental vibrational mode frequency.

Two mechanical resonances that remain in the typical balanced armature actuator are due to the diaphragm and the armature. Their resonance frequencies are expressed as the square root of a stiffness divided by a mass. For the diaphragm resonance, the stiffness is predominantly determined by the suspension material and the volume of air trapped behind the diaphragm, whereas the mass is the mass of the diaphragm itself. By increasing the stiffness or decreasing the mass, the resonance frequency can be increased. Increasing the stiffness requires more force to generate the same displacement, therefore a higher magnetic field will be required. As stated before, this is achieved in an embodiment of the present invention by using a higher number of coils and a coil material with a higher flux density.

Using a diaphragm with a lighter mass also improves high frequency efficiency, but more importantly increases the resonance frequency thereby moving unwanted phase lag out of the control bandwidth. Stiffening the driver diaphragm itself can also ultimately reduce the number of dynamics in the system. In yet another embodiment of the present invention, an ANR balanced armature actuator comprises a diaphragm 405 using stiffer and lighter materials (relative to a typical balanced armature design) such as titanium or carbon fiber. As a result, the resonances associated with the diaphragm are moved to higher frequencies out of the control bandwidth.

In an embodiment of the present invention, the connecting rod (215) is sufficiently rigid to cause the diaphragm and armature to behave as a single mass over a low frequency bandwidth, resulting in only a single resonance within this band. As the frequency increases, the stiffness of the rod becomes more important and a second system mode appears. Ideally this is the case and the connecting rod is sufficiently stiff. In this case it is also desirable to increase the system stiffness and decrease the system mass (relative to a typical balanced armature design) when the system is the diaphragm and the armature moving as a unit. This will increase the resonance of the system, which is beneficial for ANR.

Without changing the fundamental nature of the balanced armature design, it may not be possible to significantly impact the resonant properties of the armature itself. As with the diaphragm, a stiffer suspension and lighter mass armature will serve to increase the frequency of the resonance. As discussed next it is possible to redesign the balanced armature speaker to eliminate the so-called diaphragm resonance, leaving only the armature resonance.

In another embodiment, the force handling capability of the balanced armature actuator is combined with the dynamic system characteristics of the voice coil speaker design to create a hybrid actuator. Referring to FIG. 5, a hybrid actuator according to an embodiment of the present invention is illustrated. A diaphragm/armature 505 is suspended by its outer edge from a housing 500 by an airtight suspension 510. Diaphragm/armature 505 is made of a conductive material and performs the functions of the armature and the diaphragm. Diaphragm/armature 505 is sized so that its dimensions are sufficient to move the volume of air necessary for effective ANR application. The airtight suspension 510 separates the front and back volumes of the housing 500. In this embodiment, the voice coil 520 surrounds the diaphragm/armature 505 and the airtight suspension 510 is connected to the voice coil 520. When the voice coil 520 is energized, the diaphragm/armature 505 is magnetized and moves in the magnetic field created by the permanent magnets comprising a magnet assembly 525. The force available from the balanced armature is translated directly to a change in volume, and thus sound pressure is created. This embodiment overcomes the difficulty with existing designs by eliminating the mechanical system that exists between the force generating mechanism and the diaphragm that generates sound pressure. The present embodiment reduces the number of dynamics while maintaining the existing force generating mechanism. In addition, alternate polarity magnets on either side of the energized diaphragm permit the diaphragm to move in a unified motion, rather than rocking.

Another embodiment of the present invention is illustrated in FIG. 6. Referring to FIG. 6, a diaphragm/armature 605 comprises a first and second portion. The portions are approximately equal in length and are defined by a first airtight suspension 610 that is perpendicular to the diaphragm/armature 605 and attaches to the sides of housing 600. A voice coil 620 surrounds the first portion of diaphragm/armature 605. The end of the first portion of diaphragm/armature 605 is attached to housing 600 (either by hard or soft attachment points).

A second airtight suspension 615 suspends the second portion of the diaphragm/armature 605 by its outer edge from housing 600 and from first airtight suspension 610. The second portion of diaphragm/armature 605 is suspended in a magnetic field generated by a magnet assembly 625. Magnet assembly 625 is situated on top and bottom of the second portion of diaphragm/armature 605. The second suspension 615 connected to the diaphragm edge seals the top and bottom surfaces of the diaphragm from each other, and separates the components of magnet assembly 625 from each other as well. The voice coil 620 is separated from magnet assembly 625 by first airtight suspension 610. When the voice coil 620 is energized, the diaphragm/armature 605 is magnetized and moves in the magnetic field created by the permanent magnets. Because the top and bottom of the second portion of diaphragm/armature 605 are acoustically separated by second airtight surround 615, the motion of the diaphragm/armature 605 generates a sound pressure that exits at a sound port 635.

In an alternate embodiment, the first airtight suspension 610 does not extend from the bottom of the diaphragm/armature 605 to the bottom of housing 600 thereby creating a larger space below diaphragm/armature 605. This increase in the volume below the diaphragm/armature 605 decreases the force requirements to generate a high sound pressure output.

Analytical and experimental investigations of the frequency responses of currently available balanced armature actuators show that the phase lag of its response in the frequency band of interest is due mainly to three resonances of the mechanical-acoustical system of the actuator. The first resonance of the system is attributed to the mass-spring type mechanical resonance of diaphragm and elastic suspension attached to the armature and coupled to the acoustic cavities of the system. The second resonance is a Helmholtz resonance created by the acoustic cavity in front of the diaphragm and the port of the cabinet. The third resonance is the first elastic resonance of the diaphragm.

In another embodiment of the present invention, these resonances are minimize or moved out of the frequency band of interest.

Figure 7:
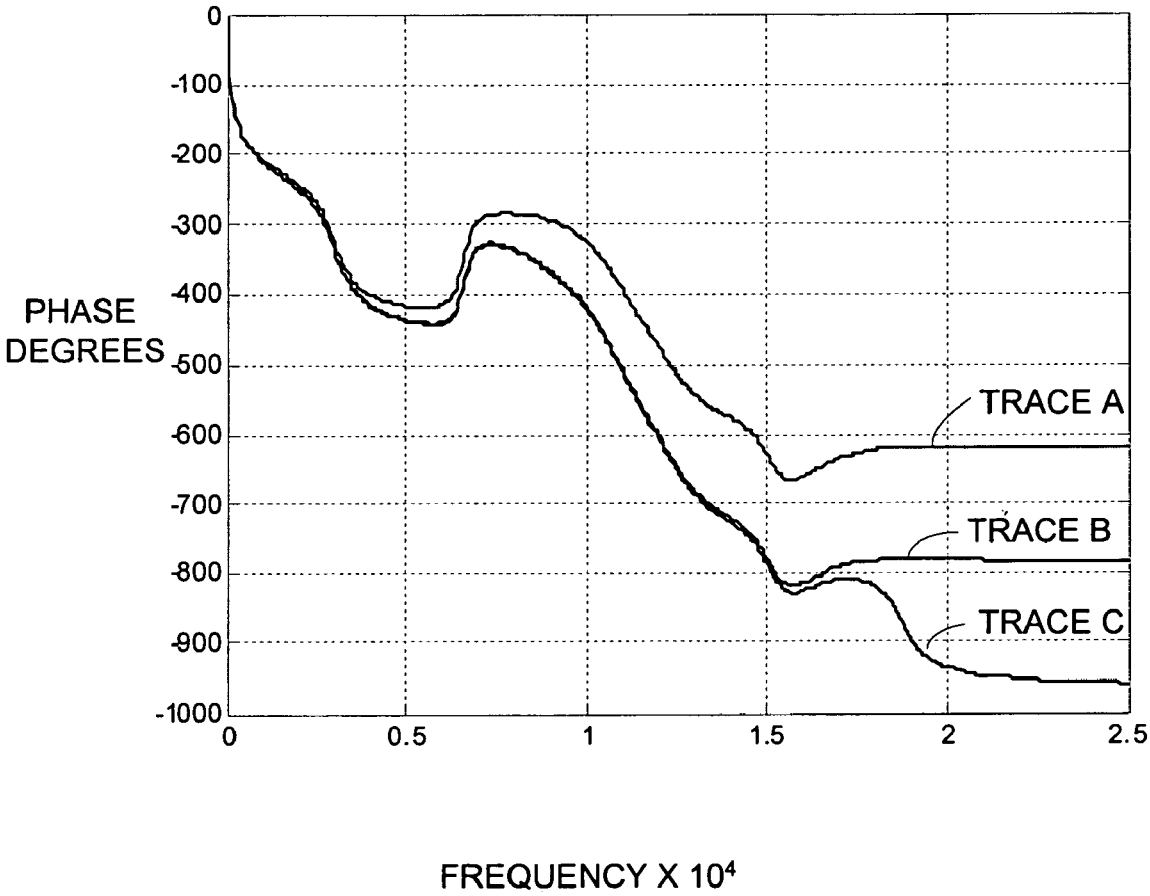
FIG. 7 illustrates the impact of the resulting modifications on the phase response of a new balanced armature design.

FIG. 7 illustrates a plot of phase (vertical axis) versus frequency (horizontal axis) for typical balanced armature actuator (trace A) and two ANR balanced armature actuators (traces B and C) according to the present invention. In an embodiment, the port on typical balance armature actuator (see FIG. 2) is eliminated causing the second resonance (Helmholtz type resonance) of the system to move outside the frequency band of interest as shown in FIG. 4. The total phase lag of the balanced armature actuator as measured by a collocated microphone is then decreased (as shown by the trace B of FIG. 7).

In prior art balanced armature designs, the diaphragm is enclosed by a front volume that is connected through a tiny slit to a port. This existing design creates an acoustic resonance that impacts the effectiveness of active control. In an embodiment, the diaphragm of the balanced armature receiver is exposed acoustically to the environment. By removing the cover and exposing a portion of the diaphragm to the environment, this resonant behavior can be eliminated for certain acoustical earplug systems. Ideally the diaphragm is completely exposed to the acoustic environment that it operates in, but the Helmholtz resonant effect can be reduced considerably by ensuring that at least 25% of the diaphragm is acoustically exposed.

Figure 8A:
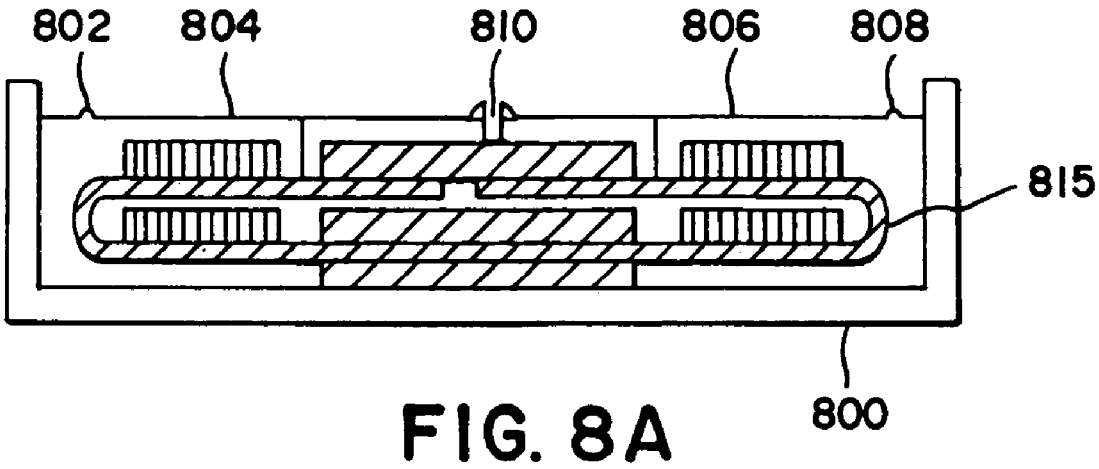
FIGS. 8A and 8B illustrate a modified balanced armature design according to embodiments of the present invention.
Figure 8B:
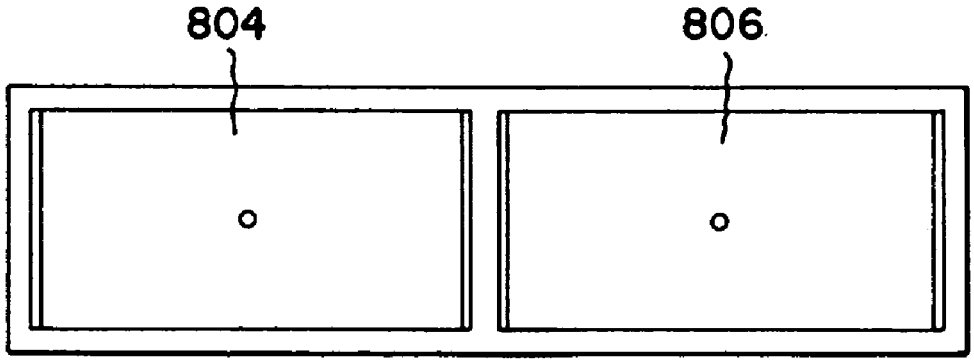

In another embodiment, the balanced armature actuator shifts the elastic resonance of the diaphragm to a higher frequency, outside the frequency band of interest, resulting in even smaller total phase lag (as shown in the trace C of FIG. 7). An embodiment of the present invention that that achieves this resonance shift is illustrated in FIGS. 8A and 8B. Referring to FIG. 8A, a first diaphragm 804 is connected at one end to housing 800 by a first suspension 802. A second diaphragm 806 is connected to the opposite end of housing 800 by a second suspension 808. A third suspension 810 joins the first diaphragm 804 with second diaphragm 806. While the diaphragm has been segmented (with respect to the typical balanced armature actuator illustrated in FIG. 2), the radiating area of the diaphragm is comparable to that of a typical balanced armature actuator and thus has the same acoustic power output. FIG. 8B further illustrate the relationship of the first diaphragm 804 and the second diaphragm 806.

In this embodiment of the present invention, the first and second diaphragms (804 and 806) are connected to a single balanced armature 815 as illustrated in FIG. 8A. In this embodiment, each balanced armature motor is scaled in such a way that the total acoustic power output of the segmented diaphragms is at least equal to the acoustic power output of a conventional balanced armature actuator with a single diaphragm and with dimensions commensurate with the actuator considered in previous embodiments. The cavity formed by the first and second diaphragms (804 and 806) and by first, second and third suspensions (802, 808, and 810) is shared by the separate diaphragms. In an alternate embodiment, the cavity formed by the first and second diaphragms (804 and 806) and by first, second and third suspensions (802, 808, and 810) is divided so that each diaphragm segment operates on a smaller (and stiffer) volume (shifting its mass-spring type resonance to a higher frequency).

In yet another embodiment, the elastic resonance of the diaphragm is shifted to a higher frequency by using a diaphragm that is thicker than ordinarily used (at the expense of more power) or fabricated from a composite (i.e. stiffer) membrane. It is important to note that such design changes would move towards better collocation of the electroacoustic transfer function, since the mechanical system responsible for the third resonance in the existing balanced armature actuator would be moved higher than the next acoustic resonance.

Several embodiments for an actuator for an ANR application have now been illustrated. The actuator for an ANR application described herein offers improved performance of CIC ANR systems. It will also be understood that the invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible.

What is claimed is:

1. A completely inside the ear canal ("CIC") speaker comprising:

a housing adapted for insertion into an ear canal, wherein the housing has an open front portion and a closed rear portion;

a diaphragm of diameter "D", wherein the diaphragm is connected to housing by a suspension, wherein the diaphragm and the closed rear portion define a rear cavity volume, wherein when the housing is inserted into the ear canal, the diaphragm and an ear drum define a front cavity volume, and wherein the front cavity volume and the rear cavity volume are approximately equal;

a magnet assembly of length "M" measured along the dimension orthogonal to the diaphragm, the magnet assembly defining a cylindrical magnetic gap; and a voice coil having a first portion rigidly attached to the diaphragm and a second portion placed in the cylindrical magnetic gap, the voice coil having a length "L" measured along the dimension orthogonal to the diaphragm surface; wherein M>L and the ratio defined by D/M is less than one.

2. The CIC speaker as in claim 1 wherein the CIC speaker has a first resonance frequency between 0 and 10 kHz, a second resonance frequency greater than or equal to 10 kHz, and sufficient voice coil linear motion to produce at least 110 dB in a 0.5 cubic centimeter volume.

3. The CIC speaker as in claim 1 wherein "D" does not exceed 4 mm.

4. The CIC speaker as in claim 1, wherein the length of the magnet assembly "M" does not exceed 11 mm.

* * * * *

UNITED STATES PATENT AND TRADEMARK OFFICE

CERTIFICATE OF CORRECTION

PATENT NO. : 7,206,425 B2
APPLICATION NO. : 10/762127
DATED : April 17, 2007
INVENTOR(S) : Michael A. Vaudrey, William R. Saunders and Andre Goldstein It is certified that error appears in the above-identified patent and that said Letters Patent is hereby corrected as shown below:

Column 1, line 12, insert the following section title and paragraph before the section entitled "Background":

--GOVERNMENT RIGHTS

This invention was made with Government support under contract F33615-02-C-6021 awarded by the Department of the Air Force. The Government has certain rights in this invention. The U.S. Government has a paid-up license in this invention and the right in limited circumstances to require the patent owner to license others on reasonable terms as provided by the terms of contract F33615-02-C-6021 awarded by the Department of the Air Force.--

Signed and Sealed this

First Day of December, 2009

David J. Kappos

David J. Kappos
*Director of the United States Patent and Trademark Office*